US010466651B2

(12) United States Patent
Schmidt et al.

(10) Patent No.: US 10,466,651 B2
(45) Date of Patent: Nov. 5, 2019

(54) WATCH GLASS

(71) Applicant: MONTRES TUDOR SA, Geneva (CH)

(72) Inventors: Gregory Schmidt, Pougny (FR); Frank Vernay, Farges (FR)

(73) Assignee: MONTRES TUDOR SA, Geneva (CH)

( * ) Notice: Subject to any disclaimer, the term of this patent is extended or adjusted under 35 U.S.C. 154(b) by 0 days.

(21) Appl. No.: 15/698,260

(22) Filed: Sep. 7, 2017

(65) Prior Publication Data

US 2018/0074460 A1 Mar. 15, 2018

(30) Foreign Application Priority Data

Sep. 9, 2016 (EP) ..... 16187992

(51) Int. Cl.
*G04B 39/00* (2006.01)
*G04B 37/08* (2006.01)
*G04D 3/06* (2006.01)

(52) U.S. Cl.
CPC ..... *G04B 39/006* (2013.01); *G04D 3/06* (2013.01); *G04B 37/08* (2013.01)

(58) Field of Classification Search
CPC ..... G04B 39/006; G04B 37/08; G04B 39/06; G04B 39/02
See application file for complete search history.

(56) References Cited

U.S. PATENT DOCUMENTS 3,643,424 A * 2/1972 Simon ..... G04B 37/055 368/291
4,456,388 A * 6/1984 Matsumoto ..... G04B 37/084 368/294
4,497,584 A * 2/1985 Ratajski ..... G04B 39/006 368/290
4,620,798 A * 11/1986 Scarinzi ..... G04B 37/0058 368/276
2012/0188857 A1* 7/2012 Sabatini ..... G04B 37/00 368/282
2013/0051201 A1* 2/2013 Oshio ..... G04G 17/08 368/309
2015/0220066 A1* 8/2015 Fujisawa ..... G04G 17/04 368/278
2017/0003660 A1* 1/2017 David ..... G04B 19/283

FOREIGN PATENT DOCUMENTS

CH 310 556 A 10/1955
CH 505 414 A 8/1970
CH 541 829 A 5/1973
EP 0 097 393 A1 1/1984

OTHER PUBLICATIONS

European Search Report and Written Opinion dated Feb. 28, 2017 issued in counterpart application No. EP16187992; w/ English partial translation and partial machine translation (16 pages).

* cited by examiner

*Primary Examiner* — Sean P Kayes
(74) *Attorney, Agent, or Firm* — Westerman, Hattori, Daniels & Adrian, LLP

(57) ABSTRACT

Watch glass (1) including a first element (2) made of a first material and a second element (3) made of a second material different from the first, more elastic than the first material, the second element (3) includes a skirt (3*b*) in its lower part, and the two elements (2, 3) are fixed to each other so that the first element (2) is oriented toward the exterior of a watch and the skirt of the second element (3) is adapted for the assembly of the watch glass (1) to a watch middle (4).

20 Claims, 3 Drawing Sheets

WATCH GLASS

This application claims priority of European patent application No. EP16187992.9 filed Sep. 9, 2016, which is hereby incorporated herein in its entirety.

The invention concerns a watch glass. It also concerns a watch case and a timepiece in themselves comprising a watch glass of this kind.

The document CH310556 describes a prior art watch case, comprising a one-piece watch glass. This solution necessitates the use of a relatively elastic material and is not compatible with stronger materials such as sapphire.

An object of the present invention is to propose an improved watch glass solution and notably to achieve some or all of the following objects.

A first object of the invention is to propose a watch glass that is particularly resistant to scratches in particular.

A second object of the invention is to propose a watch glass that is simple to assemble to a watch case, enabling an appropriate seal to be achieved.

A third object of the invention is to propose a particularly esthetic watch glass.

To this end, the invention is based on a watch glass including a first element made of a first material and a second element made of a second material different from the first, the second element includes a skirt in its lower part and the two elements are fixed to each other so that the first element is oriented toward the exterior of a watch in a direction opposite to the direction of the skirt and the skirt of the second element is adapted for the assembly of the watch glass to a watch middle.

The skirt preferably has a wall of frustoconical shape.

The second element can include a horizontal first part the upper surface of which, in section in a median vertical transverse plane, extends over a length between one fifth and half inclusive the length of the lower surface of the first element which is therefore partially superposed on it. Alternatively, it extends over substantially all this length. These two elements are therefore advantageously superposed over a large area. They can therefore include respective superposed surfaces in contact. These two superposed surfaces in contact are preferably fixed to each other, notably by gluing.

The invention is more precisely defined by the points below.

1. A watch glass including a first element made of a first material and a second element made of a second material different from the first, more elastic than the first material, the second element includes a skirt in its lower part, having a wall of frustoconical shape, the two elements are fixed to each other so that the first element is intended for an orientation toward the exterior of a watch and the skirt of the second element is adapted for the assembly of the watch glass to a watch middle.

2. The watch glass as defined in the preceding point, wherein the first material is sapphire and the second material is a polymer, notably polymethyl methacrylate (PMMA).

3. The watch glass as defined in either one of the preceding points, wherein the two elements are fixed together by gluing between at least two respective substantially horizontal surfaces.

4. The watch glass as defined in any one of the preceding points, wherein the second element includes a horizontal first part, the upper surface of which is substantially the same size as the lower surface of the first element, which is therefore superposed on it over all its surface.

5. The watch glass as defined in any one of points 1 to 3, wherein the second element includes a horizontal first part the upper surface of which extends over a length between one fifth and half inclusive the length of the lower surface of the first element, which is therefore partially superposed on it.

6. The watch lens as defined in any one of the preceding points, wherein the skirt of the second element takes the form of a substantially vertical extension that extends downward from all of the perimeter of the second element at the level of its periphery.

7. The watch glass as defined in any one of the preceding points, wherein the skirt includes an area of lower mechanical strength.

8. The watch glass as defined in any one of the preceding points, wherein the upper surface of the second element has some or all of the following features:

- at least one recess in which is housed a decoration element, notably formed of precious or semi-precious stones, or an element coated with luminescent material;
- at least one surface texture;
- surface reliefs;
- at least one surface metallization;
- at least one surface printing.

9. A watch case including a watch glass as defined in any one of the preceding points.

10. The watch case as defined in the preceding point, comprising a watch middle that includes an upward vertical extension the exterior surface of which is in contact with an interior surface of the skirt of the second element of the watch glass, and comprising a bezel that surrounds the watch glass, holding it pressed against the watch middle.

11. The watch case as defined in the preceding point, wherein the skirt includes a wall of frustoconical shape and the exterior surface of the watch middle has an inclined surface substantially corresponding to the frustoconical shape of the skirt.

12. A timepiece including a watch glass as defined in any one of points 1 to 8 or a watch case as defined in any one of points 9 to 11.

The above objects, features and advantages of the present invention are explained in detail in the following description of particular embodiments given by way of nonlimiting example and with reference to the appended figures, in which.

Figure 1:
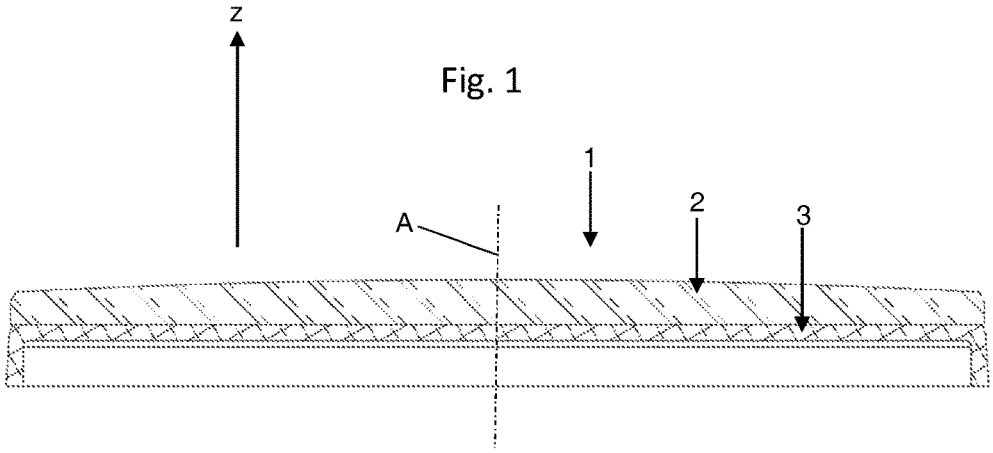
FIG. 1 is a view in section on a transverse median plane of a watch glass according to a first variant of a first embodiment of the invention.

FIG. 1 shows a watch glass 1 according to a first embodiment of the invention. The watch glass includes a first element 2, made of a first rigid material, in particular a transparent first rigid material, preferably sapphire, intended to be oriented toward the exterior of a watch middle. It further includes a second element 3 made of a more elastic second material, in particular a transparent more elastic second material, notably a polymer material, fixed to the first element 2. The watch glass 1 is preferably symmetrical about an axis A of revolution.

By convention, by vertical direction z is meant a direction parallel to the axis A of the watch glass, notably the axis A of revolution of the watch glass, and oriented in the direction from the second element 3 to the first element 2. The adjectives "upper" and "lower" will therefore be used to locate various elements by considering their position in this vertical direction. Additionally, the adjectives "interior" and "exterior" will be used with reference to a watch case to which the watch glass according to the invention is assembled. Finally, by horizontal direction is meant any direction perpendicular to the vertical direction. FIGS. 1 to 7 are views in section on a transverse median plane of the watch glass according to the invention containing the axis A. These views are partial or complete.

According to the first embodiment from FIG. 1, the first element 2 of the watch glass 1 is substantially in the form of a disk, with axis A of revolution, the upper surface of which is slightly domed, and notably has a convex geometry. The second element 3 includes an upper first part 3*a* of disk shape having a diameter substantially equal to that of the disk formed by the first element 2, enabling the fixing of its upper surface to all of the lower surface 2*a* of the first element 2, or alternatively to only a part of that surface. Finally, the second element 3 includes a second part, forming a skirt 3*b*, taking the form of a substantially vertical wall or extension that extends downward from the entire perimeter of the second element 3, at the level of its periphery, of substantially annular horizontal section, with axis A. The skirt 3*b* has a substantially cylindrical shape with axis A in the first embodiment. The first part 3*a* has the function of fixing the first element 2 and the skirt 3*b* has the function of assembly with a watch middle, as explained hereinafter.

Figure 2:
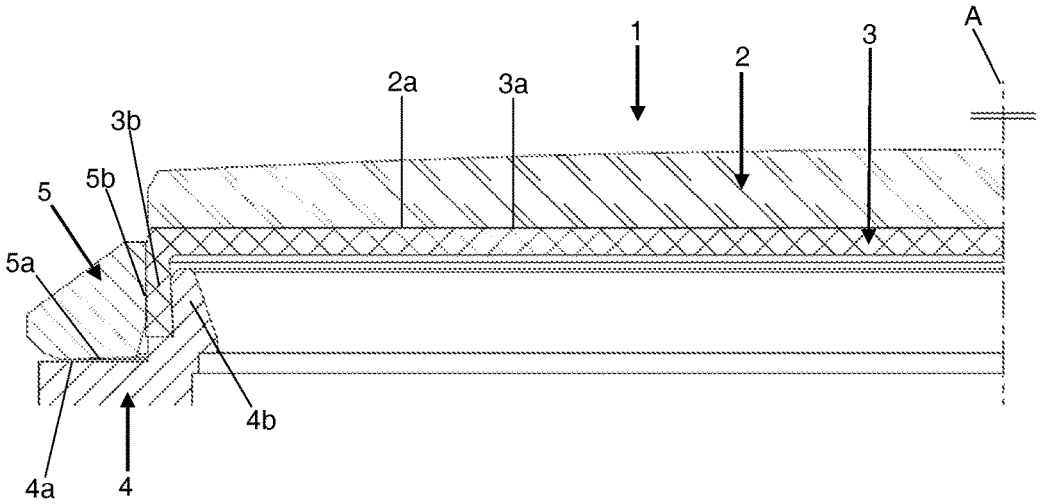
FIG. 2 is a view in cross section of the watch glass according to the first variant of the first embodiment of the invention mounted on a watch middle.

FIG. 2 shows the watch glass 1 according to the first embodiment assembled to a watch middle 4. The assembly method is more particularly described hereinafter with reference to FIGS. 3 and 4. In the assembled position the middle 4 has a vertical extension 4*b* oriented upwards, the exterior surface of which, substantially vertical, comes into contact with the interior surface of the skirt 3*b* of the second element 3 of the watch glass 1. A bezel 5 surrounds this assembly, includes a horizontal lower first surface 5*a* that rests on a horizontal surface 4*a* of the watch middle 4 and a substantially vertical second surface 5*b* that comes into contact with the exterior surface of the skirt 3*b*. The arrangement of the various components is such that the skirt 3*b* of the watch glass 1 is therefore compressed radially against the middle 4 by the bezel 5, guaranteeing the retention of the watch glass 1 on a watch middle and the sealing of the watch case. Note that this assembly solution has the advantage of great simplicity, does not necessitate a specific seal. Moreover it makes it possible to achieve a highly esthetic result. In the final position, the first element 2 is oriented toward the exterior of the watch. The skirt 3*b* extends in a direction opposite the first element 2.

As emerges from the foregoing description, the first element 2 has a first function of resisting impact and scratching and an esthetic second function. To this end it is advantageously made from a very strong first material of attractive esthetic appearance, preferably sapphire. The second element 3 has the main function of assembly onto a watch middle, and can participate in the esthetic effect, as illustrated hereinafter. It must therefore be made from a material sufficiently rigid to guarantee strong retention of the watch glass and to withstand forces after it is mounted, whilst having an elastic property sufficient to enable the assembly of its skirt and provide the seal, which notably involves bending stresses. The first and second materials are therefore necessarily different, the second being less rigid and more elastic than the first. To this end, the second material is advantageously a polymer, advantageously polymethyl methacrylate (PMMA), a material that satisfies the abovementioned constraints whilst having the advantage of very great optical transparency and excellent resistance to ultraviolet rays. Alternatively, the second material used could be any other amorphous polymer such as polycarbonate (PC), polystyrene (PS), acrylonitrile butadiene styrene (ABS), polyvinyl chloride (PVC), polyethylene terephthalate (PET), polycarbonate/polyethylene terephthalate (PC/PET), or polyurethanes (PU or PUR), . . . .

Moreover, according to the embodiment, the fixing of the two elements 2, 3 of the watch glass 1 is obtained by gluing, notably by ultraviolet gluing. As they have a large contact area, gluing them over this area makes it possible to obtain reliable and durable adhesion. In this first embodiment, this contact surface corresponds to substantially all the lower surface 2*a* of the first element 2 (and therefore all the upper surface of the second element 3), which maximizes the retention of the first element 2 on the second element, and then indirectly on a watch case, whilst having the advantage of a laminated glass structure, which improves overall strength, notably useful in the event of an extremely violent shock that entails the risk of breaking the first element 2. Alternatively, other types of gluing or more generally of fixing could be employed, for example mechanical fixing such as riveting, notably by way of ancillary elements such as rivets. The two elements 2, 3 are therefore fixed to each other and superposed in a vertical direction. According to another alternative, the second element 3 could be overmolded onto the first element 2, in particular the skirt 3*b* of the element 3 could be overmolded onto the lower surface of the element 2 and/or onto a lateral wall of the element 2.

Figure 3:
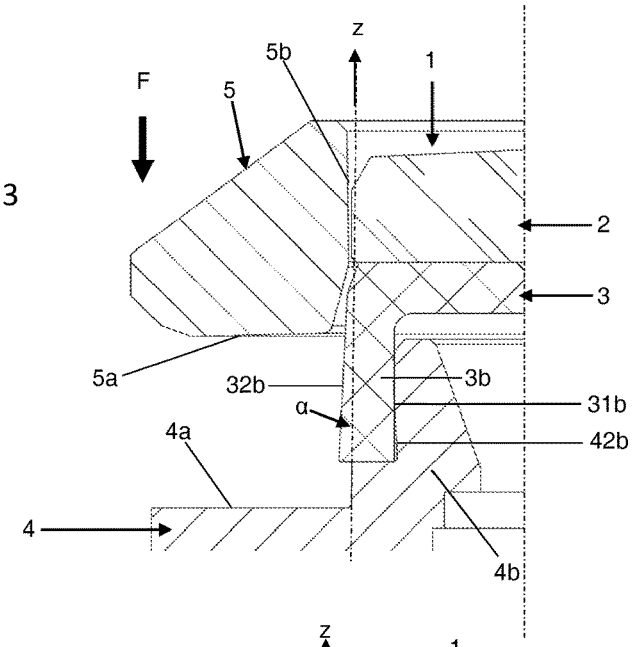
FIGS. 3 and 4 are views in cross section of the method of assembling a watch glass according to the first variant of the first embodiment of the invention to a watch middle.
Figure 4:
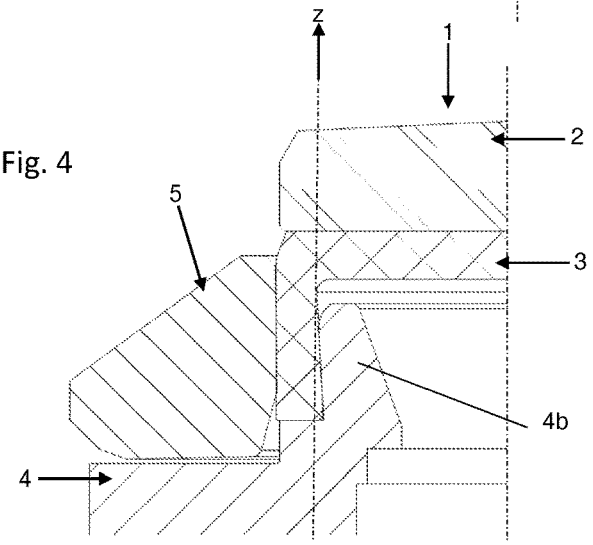

FIGS. 3 and 4 show phases of assembling a watch glass as shown in FIG. 1 according to the first variant of the first embodiment of the invention on a watch middle 4. In this variant embodiment, the skirt 3*b* of the second element 3 of the watch glass 1 does not have a perfectly cylindrical shape with axis A, but rather has a section in a vertical plane of frustoconical shape. To be more precise, in the variant shown and visible in FIG. 3, in which the skirt 3*b* occupies its natural rest position, the interior surface 31*b* of the skirt 3*b* is substantially vertical, parallel to the axis A of the watch glass 1, whereas its exterior surface 32*b* is slightly inclined outwards, with the result that the thickness of the skirt 3*b* regularly increases in the direction toward its lower side. This inclination relative to the vertical direction by an angle $\alpha$ is advantageously small, of the order of 3 degrees, between 0 and 10 degrees inclusive, or even between 2 and 4 degrees inclusive. In this variant embodiment the vertical outward extension 4*b* of the watch middle 4 has an exterior surface 42*b* that is likewise slightly inclined, at substantially the same angle as the angle $\alpha$ of orientation of the surface 32*b*, of complementary different orientation, i.e. the exterior surface 42*b* diverges in the upward direction.

FIG. 3 shows an initial phase of a method of assembling a watch glass 1 according to the invention to a watch middle 4. The watch glass 1 has been positioned to abut on the watch middle 4 so that the horizontal lower surface of the skirt 3*b* bears on a horizontal receiving surface of the watch middle 4, substantially at the base of the vertical extension 4*b* of the watch middle 4. A bezel 5 is offered up from above, vertically, around the exterior surface of the watch glass 1. This bezel 5 is then progressively lowered to its final position shown in FIG. 4, in which the watch glass 1 is finally mounted on the watch middle 4.

To facilitate the descent of the bezel 5 in the direction F in this assembly method, the lower extremity of the vertical interior wall 5*b* of the bezel 5 includes a chamfer. In a complementary manner, the interior wall 5*b* can have a substantially frustoconical shape. This interior surface 5*b* descends whilst bearing on the exterior surface of the watch glass 1, and then comes to push on the skirt 3*b* because of its frustoconical shape and its outwardly inclined exterior surface 32*b*. This skirt 3*b* is therefore compressed inwards and deforms slightly inwards in bending thanks to its elastic property, because of the second material employed and its shape. In the final position, its exterior surface 32*b* espouses the shape of the vertical interior surface 5*b* of the bezel 5. In this constrained position, the interior surface 31*b* of the skirt 3*b* therefore comes to be inclined at an angle $\alpha$. This inclination corresponds exactly or substantially to that of the exterior surface 42*b* of the watch middle 4 with the result that these corresponding two surfaces 31*b*, 42*b* are retained in bearing engagement over the whole of their surface by the bezel 5. The vertical extension 4*b* can have some elasticity so as to guarantee the bearing interengagement of the surfaces 31*b*, 42*b*. This final configuration makes it possible to avoid any accidental pulling off of the watch glass 1, whilst guaranteeing that the assembly is sealed, even without the use of a seal. This is therefore a notched mounting of the watch glass 1 on the middle 4.

Figure 5:
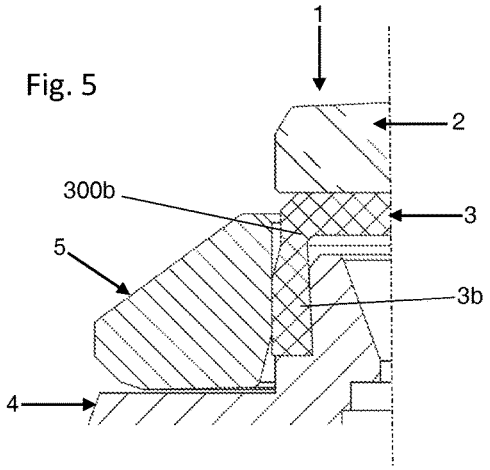
FIG. 5 is a view in cross section of the assembly of a second variant of a watch glass according to the first embodiment of the invention onto a watch middle.

FIG. 5 shows a watch glass 1 according to a second variant of the first embodiment of the invention, mounted on a watch middle 4. In this embodiment the skirt 3*b* includes a weaker area 300*b* that takes the form of a thinner zone positioned in the upper part of the skirt 3*b*. This weaker area 300*b* has the effect of favoring the flexing of the skirt 3*b* during assembly, by minimizing the internal stresses in the material of the skirt, making it possible to remain more easily within the mechanical characteristics of the second material used for the second element 3.

Figure 6:
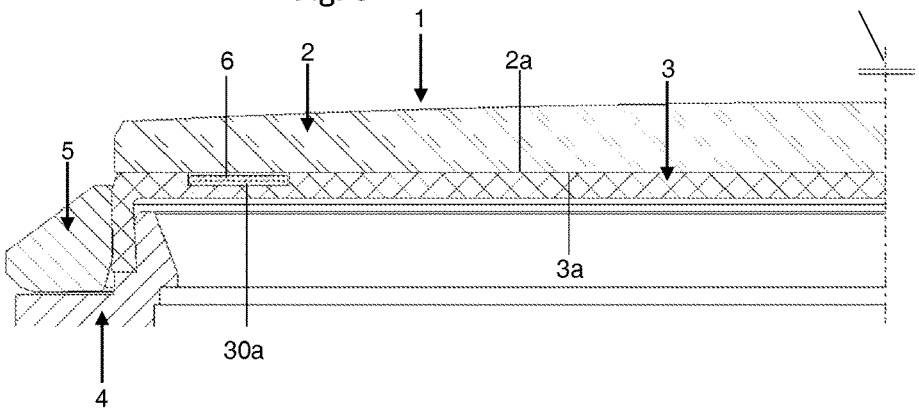
FIG. 6 is a view in cross section of a watch glass according to a third variant of the first embodiment of the invention mounted on a watch middle.

FIG. 6 shows the same view as FIG. 2 with a watch glass according to a third variant embodiment of the invention. In this variant, the disk-shaped first part 3*a* of the second element 3 comprises a recess 30*a* in its horizontal upper surface for housing a decoration element 6. A decoration element 6 of this kind can for example consist of a precious or semi-precious stone. It can equally consist in a display or other element, covered with luminescent material. It is visible from the outside by virtue of the transparency of the first element 2 of the watch glass. Its position "sandwiched" between the two elements 2, 3 of the watch glass enables it to be perfectly retained and protected from exterior aggression. Alternatively, a recess can equally be provided on the horizontal upper face of the second element 3 so as to constitute a reservoir of glue, notably with the object of containing surplus glue deposited during the gluing of the elements 2 and 3. In this case, the recess 30*a* is disposed so that it is not visible to the wearer, for example on the perimeter of the middle, notably at the level of the bezel ring of the middle.

Alternatively, other types of decoration can be obtained without necessarily providing any recess in the second element 3. For example, this second element 3 can be at least partly colored. A solution of this kind makes it possible to obtain an alternative result to colored sapphire glass. According to another example, the upper surface of the first part 3*a* of the second element 3 can include a decoration that can consist in some or all of the elements from the following group: surface texture, patterns in relief, surface metallization, surface color printing, etc. These approaches can generate decoration patterns, which patterns can consist in any decorative design and/or any particular indications. These approaches can also generate functional patterns, such as for example surface textures reproducing lenses, in particular Fresnel lenses. The first element 2 superposed on at least one such pattern makes it possible to protect it from exterior aggression such as shocks and to guarantee its durability.

Naturally, other variant embodiments can be obtained by simply combining the foregoing variant embodiments.

Figure 7:
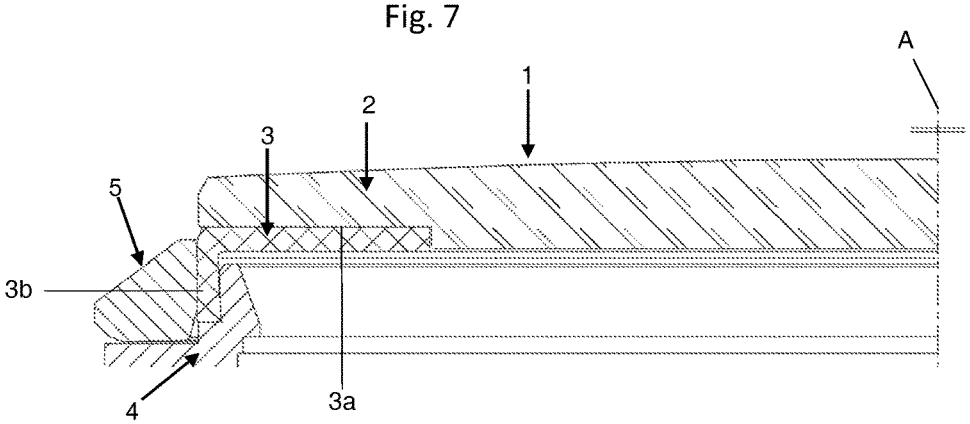
FIG. 7 is a view in cross section of a watch glass according to a second embodiment of the invention on a watch middle.
Figure 8:
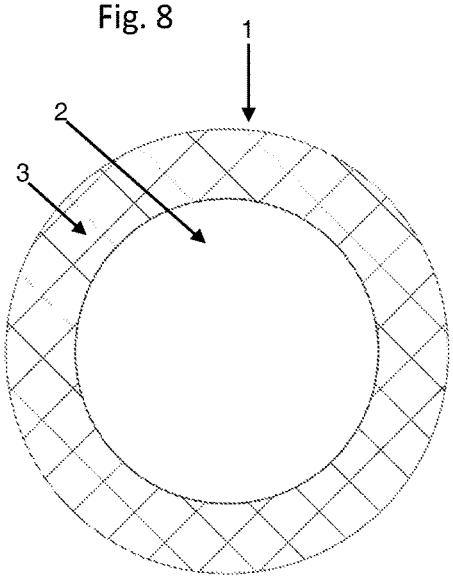
FIG. 8 is a plan view of the watch glass according to the second embodiment of the invention.

FIGS. 7 and 8 show a second embodiment of the invention. FIG. 7 shows a watch glass 1 according to this second embodiment mounted on a watch middle 4. The watch glass 1 differs from that of the first embodiment in that the first part 3*a* of the second element 3 does not extend over all the lower surface of the first element 2. It extends from the exterior edge of the first element 2, over a distance representing approximately one third of the radius of the disk forming the first element 2. More generally, this part 3*a* can extend over only a part of the length of the lower surface 2*a* of the first element 2, whatever its shape. This length preferably represents at least one fifth of the total length of the lower surface 2*a* of the first element 2. This length can moreover represent at most half the total length of the lower surface 2*a* of the first element 2. This lower surface 2*a* is preferably delimited by a step disposed at the level of the interior edge of the part 3*a*, so that the central zone of the first element 2 is lower than the exterior zone of the first element 2, with a thickness of the same order as that of the first part 3*a* of the second element: the watch glass 1 therefore retains a substantially continuous lower surface that is substantially plane and horizontal. The skirt 3*b* retains the same features as in the first embodiment. As can be seen more particularly in FIGS. 7 and 8, the first part 3*a* of the second element 3 forms a substantially horizontal ring.

All the variants of the first embodiment can be reproduced in this second embodiment.

The invention is naturally not limited to the embodiments shown. Specifically, it is not limited to a watch glass with a circular contour, but can be adapted to any shape to match any shape of watch middle, for example rectangular or of "barrel" type or "tonneau" type. The upper surface of the watch glass can be plane or convex. The lower surface of the watch glass can be plane or convex. Moreover, the watch glass can comprise more than two elements. It could notably comprise at least one decoration element 6 as proposed in the context of the third variant of the first embodiment of the invention. It could moreover include an exterior element, for example a magnifier facilitating the reading of a time or time-derived indication. The exterior element is advantageously made of the aforementioned rigid material, notably of sapphire.

Finally, the invention also relates to a watch case including a watch glass as described above and a timepiece including a watch case of that kind.

The invention claimed is:

1. A watch glass comprising:

a first element made of a first material, and a second element made of a second material different from the first material and more elastic than the first material, wherein the second element includes a skirt in a lower part of the second element, the skirt having a wall of frustoconical shape, and a first part that defines a top most surface of the second element below at least a portion of the first element and extends radially inward beyond an inner edge of the skirt, wherein the first and second elements are fixed to each other so that the first element is configured for an orientation toward the exterior of a watch and the skirt of the second element is adapted for assembly of the watch glass to a watch middle.

2. The watch glass as claimed in claim 1, wherein the first material is sapphire and the second material is a polymer.

3. The watch glass as claimed in claim 2, wherein the first material is sapphire and the second material is polymethyl methacrylate (PMMA).

4. The watch glass as claimed in claim 2, wherein the first part of the second element extends radially inwardly in a horizontal direction and an upper surface of the first part of the second element is substantially of a same size as a lower surface of the first element, so that the lower surface of the first element is superposed, over an entire surface area of the lower surface of the first element, on the upper surface of the first part of the second element.

5. The watch glass as claimed in claim 2, wherein the first part of the second element extends radially inwardly in a horizontal direction and an upper surface of the first part of the second element extends over a length of from one fifth to one half inclusive relative to a length of a lower surface of the first element, so that the lower surface of the first element is superposed, over a portion of the surface area of the lower surface of the first element, on the upper surface of the first part of the second element.

6. The watch lens as claimed in claim 2, wherein the skirt of the second element has a form of a substantially vertical extension that extends downward from all of a perimeter of the second element at a level of a periphery of the second element.

7. The watch glass as claimed in claim 1, wherein the first and second elements are fixed together by gluing between at least two respective substantially horizontal surfaces.

8. The watch glass as claimed in claim 7, wherein the first part of the second element extends radially inwardly in a horizontal direction and an upper surface of the first part of the second element is substantially of a same size as a lower surface of the first element, so that the lower surface of the first element is superposed, over an entire surface area of the lower surface of the first element, on the upper surface of the first part of the second element.

9. The watch glass as claimed in claim 7, wherein the first part of the second element extends radially inwardly in a horizontal direction and an upper surface of the first part of the second element extends over a length of from one fifth to one half inclusive relative to a length of a lower surface of the first element, so that the lower surface of the first element is superposed, over a portion of the surface area of the lower surface of the first element, on the upper surface of the first part of the second element.

10. The watch glass as claimed in claim 1, wherein the first part of the second element extends radially inwardly in a horizontal direction and an upper surface of the first part of the second element is substantially of a same size as a lower surface of the first element, so that the lower surface of the first element is superposed, over an entire surface area of the lower surface of the first element, on the upper surface of the first part of the second element.

11. The watch glass as claimed in claim 1, wherein the first part of the second element extends radially inwardly in a horizontal direction and an upper surface of the first part of the second element extends over a length of from one fifth to one half inclusive relative to a length of a lower surface of the first element, so that the lower surface of the first element is superposed, over a portion of the surface area of the lower surface of the first element, on the upper surface of the first part of the second element.

12. The watch lens as claimed in claim 1, wherein the skirt of the second element has a form of a substantially vertical extension that extends downward from all of a perimeter of the second element at a level of a periphery of the second element.

13. The watch glass as claimed in claim 1, wherein the skirt includes an area of lower mechanical strength.

14. The watch glass as claimed in claim 1, wherein an upper surface of the second element has some or all of the following features:

at least one recess in which is housed at least one of (i) a decoration element and (ii) an element coated with luminescent material;

at least one surface texture;

surface reliefs;

at least one surface metallization;

at least one surface printing.

15. The watch glass as claimed in claim 14, wherein the upper surface of the second element has at least one recess in which is housed a decoration element formed of precious or semi-precious stones.

16. A watch case including a watch glass as claimed in claim 1.

17. The watch case as claimed in claim 16, comprising:

a watch middle that includes an upward vertical extension, wherein an exterior surface of the extension is in contact with an interior surface of the skirt of the second element of the watch glass, and a bezel that surrounds the watch glass, holding the watch glass pressed against the watch middle.

18. The watch case as claimed in claim 17, wherein the skirt includes a wall of frustoconical shape and an exterior surface of the watch middle has an inclined surface substantially corresponding to the frustoconical shape of the skirt.

19. A timepiece including a watch case as claimed in claim 16.

20. A timepiece including a watch glass as claimed in claim 1.

* * * * *